United States Patent [19]

Takahashi

[11] 4,136,424

[45] Jan. 30, 1979

[54] BRIDGE TOP STOP FOR SLIDE FASTENERS

[75] Inventor: Kihei Takahashi, Uozu, Japan

[73] Assignee: Yoshida Kogyo K.K., Tokyo, Japan

[21] Appl. No.: 875,142

[22] Filed: Feb. 6, 1978

[30] Foreign Application Priority Data

Feb. 10, 1977 [JP] Japan ..... 52-16722

[51] Int. Cl.[2] ..... A44B 19/36

[52] U.S. Cl. ..... 24/205.11 R

[58] Field of Search ..... 24/205.11 R

[56] References Cited

U.S. PATENT DOCUMENTS

| | | | |
|---|---|---|---|
| D. 141,873 | 7/1945 | Brozek | 24/205.11 R |
| 2,191,280 | 2/1940 | Kiessling | 24/205.11 R |
| 2,231,645 | 2/1941 | Ulrich | 24/205.11 R |
| 2,397,037 | 3/1946 | Norkin | 24/205.11 R |
| 2,501,643 | 3/1950 | Erhardt | 24/205.11 R |

FOREIGN PATENT DOCUMENTS

| | | | |
|---|---|---|---|
| 456924 | 5/1949 | Canada | 24/205.11 R |
| 6801782 | 2/1968 | Netherlands | 24/205.11 R |

*Primary Examiner*—Bernard A. Gelak

*Attorney, Agent, or Firm*—Bucknam and Archer

[57] ABSTRACT

A bridge top stop comprises a web having a widened lower end and a contracted upper end, a pair of transversely spaced, pointed legs at the lower end of the web, and another pair of transversely spaced, pointed legs at the upper end of the web. Piercing a pair of stringer tapes, the two pairs of legs are clinched to engage the usual edge beads of the tapes, with the lower legs maintaining the tape edge beads in spaced parallelism and the upper legs maintaining the beads in close juxtaposition.

4 Claims, 5 Drawing Figures

BRIDGE TOP STOP FOR SLIDE FASTENERS

BACKGROUND OF THE INVENTION

1. Field of the Invention

This invention relates to slide fasteners, and more particularly to improvements in what is commonly known as a bridge top stop for use on a pair of fastener stringers for limiting the upward or fastener closing movement of a slider. Slide fasteners incorporating such bridge top stops are applied, for example, to garment pockets, bag openings, and other closure openings which are inseparably connected together at both ends.

2. Description of the Prior Art

A bridge top stop, as heretofore constructed, usually comprises an inverted U-shape including a pair of tape gripping portions for engaging the opposed beaded or reinforced edges of stringer tapes, with a recess formed centrally in the top extending between the tape gripping portions. As the top stop is mounted in position on the stringers, the edge beads of the tapes extend through the central recess in the stop. The top stop thus mounted on the stringers are extremely insecure because of its recessed central portion which is incapable of gripping the tape edge beads. In the use of the slide fastener, therefore, the top stop is easy to be displaced upwardly as the slider is repeatedly thrusted thereagainst upon full closure of the fastener. The top stop is also susceptible to displacement or deformation when the fastener is subjected to a stress tending to pull its stringers away from each other.

According to another proposal, a V-shaped bridge top stop has been suggested which can be more securely affixed to fastener stringers. This second known top stop is also objectionable, however, in that the device when mounted in position on the stringer tapes causes their upper end portions to lap crosswise, making it difficult to stitch the tapes onto a garment or other desired article.

SUMMARY OF THE INVENTION

It is an object of this invention to provide an improved bridge top stop which can be attached to a pair of fastener stringers so stably that it will be maintained in position thereon throughout the life expectation of the fastener.

Another object of the invention is to provide an improved bridge top stop which can be attached to fastener stringers in such a way that the upper end portions of the stringer tapes can be maintained in parallel, coplanar relationship to each other.

A further object of the invention is to provide a bridge top stop of the above improved characteristics which is easy and economical of manufacture and which can be readily mounted in position on fastener stringers.

Stated in brief, a bridge top stop in accordance with this invention includes a web having a lower end of greater width than its upper end. Formed integral with this web are a pair of legs disposed on both sides of its lower end and engaging the respective beaded inner edges of a pair of stringer tapes to maintain the beaded tape edges in spaced parallelism, and another pair of legs disposed on both sides of the upper end of the web and engaging respective beaded tape edges to maintain same in close juxtaposition.

It is thus seen that the bridge top stop is securely attached to the stringers by the two leg pairs spaced in the longitudinal direction of the fastener, practically against any possibility of displacement or deformation in spite of the repeated thrust of the slider thereagainst. Moreover, the top stop maintains the upper end portions of the stringer tapes in juxtaposition to facilitate the stitching of the tapes onto a desired article.

The above and other objects, features and advantages of this invention and the manner of attaining them will become more readily apparent, and the invention itself will best be understood, from the following description and appended claims taken together with the accompanying drawings showing a preferred embodiment of the invention.

DESCRIPTION OF THE PREFERRED EMBODIMENT

Figure 1:
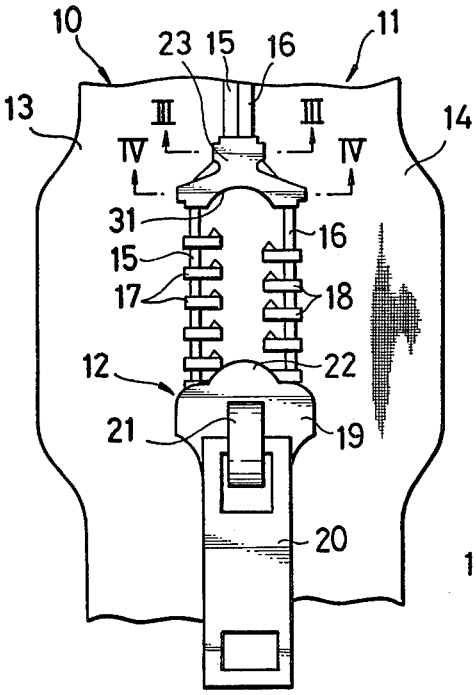
FIG. 1 is a partial front view of a slide fastener incorporating a preferred form of the bridge top stop in accordance with this invention.

In FIG. 1 of the drawings there in shown a slide fastener comprising a pair of stringers 10 and 11 and a slider 12 for connecting and disconnecting the stringers. These fastener stringers comprise flexible tapes 13 and 14 having beaded or reinforced inner edges 15 and 16, and rows of interlocking fastener elements or scoops 17 and 18 attached to the respective beaded inner edges of the stringer tapes. The fastener elements 17 and 18 are shown to be of the discrete type. The slider 12 is movable along the rows of fastener elements 17 and 18 in either direction for engaging or disengaging same, that is, for closing or opening the fastener.

The slider 12 can be of any desired form and construction and of conventional make including a body 19 and a pull tab 20, the latter being pivoted at 21 to the former. Preferably, however, the slider body 19 should be formed to include a protuberance such as a convexity 22 which is located centrally at and projecting upwardly from its flared front or upper end.

At 23 in FIG. 1 is shown a bridge top stop constructed in accordance with this invention. The top stop 23 is affixed to the stringer tapes 13 and 14 at or adjacent their upper ends, in the manner described later, for arresting the upward movement of the slider 12 in the operation of closing or connecting the fastener stringers 10 and 11.

Figure 2:
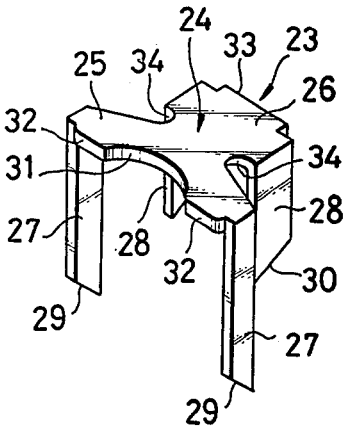
FIG. 2 is an enlarged perspective view of the bridge top stop of FIG. 1, the top stop being shown in a state before being attached to the fastener stringers.

FIG. 2 illustrates, in perspective and on an enlarged scale, the top stop 23 in its state before being mounted in position on the stringers 10 and 11. The top stop 23 includes a web 24 having a lower end 25 considerably wider than its upper end 26. This web 24 is formed integral with a pair of legs 27 disposed on the opposite sides of its lower end 25 and extending rearwardly right-angularly therefrom, and with another pair of legs 28 disposed on the opposite sides of its upper end 26 and also extending rearwardly therefrom.

Preferably, all these legs 27 and 28 have their ends bias-cut or otherwise pointed, as indicated at 29 and 30, in order to make the top stop 23 easier to be mounted on the stringers 10 and 11. Formed centrally in the lower end 25 of the web 24 is a recess such as a concavity 31 for closely receiving the convexity 22 on the slider body 19 when the slider is moved into abutting contact with the top stop 23.

Figure 3:
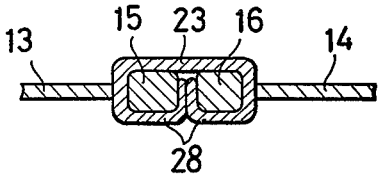
FIG. 3 is an enlarged section on the line III—III of FIG. 1.
Figure 4:
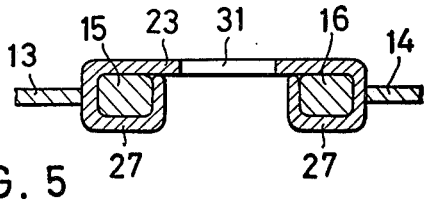
FIG. 4 is also an enlarged section on the line IV—IV of FIG. 1.
Figure 5:
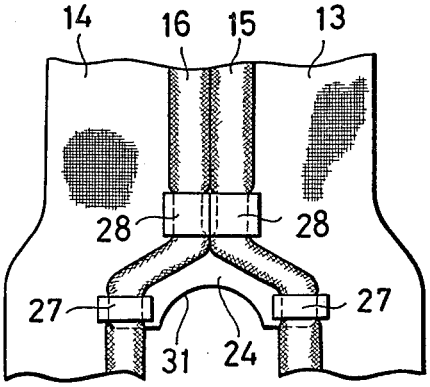
FIG. 5 is an enlarged, partial rear view of the slide fastener of FIG. 1 including the top stop.

A consideration of FIGS. 3, 4 and 5 will make clear the manner of attaching the top stop 23 of the foregoing configuration to the stringer tapes 13 and 14. The web 24 of the top stop 23 is first laid upon the front surfaces of the stringer tapes 13 and 14, in a position just above the topmost ones of the fastener elements 17 and 18 thereon. The pointed legs 27 and 28 on the web 24 are thrusted through the stringer tapes 13 and 14, just outside of their edge beads 15 and 16, and are clinched inwardly so as to engage or encircle the edge beads.

As will be seen from FIG. 3, the pair of pointed legs 28 at the upper end 26 of the web 24 are spaced from each other a distance approximately equal to the total width of the two edge beads 15 and 16. The pointed legs 28, when bent around and over the edge beads 15 and 16, have their end portions extending parallel to and contacting each other. Thus, as the top stop 23 is attached to the stringer tapes 13 and 14 as above, their edge beads 15 and 16 are maintained stably in close juxtaposition by the upper legs 28. The spacing between the pair of legs 27 at the lower end 25 of the web 24 is considerably greater than the spacing between the upper legs 28. As shown in FIG. 4, the legs 27 are disposed around and over the edge beads 15 and 16 have their ends abutting against the undersurface of the web 24. Therefore, the edge beads 15 and 16 are maintained stably in parallel spaced relationship by the lower legs 27, in order to permit the slider 12 to move smoothly into and out of contact with the top stop 23.

Thus, the bridge top stop 23 in accordance with this invention, is securely attached to the stringer tapes 13 and 14 by the lower and the upper pairs of legs 27 and 28 engaging the tape edge beads 15 and 16, so that the top stop is not to be easily displaced, dislodged or deformed in use in spite of the repeated thrust of the slider 12 thereagainst. It will also be appreciated that the top stop 23 connects the stringer tapes 13 and 14 in such a way that their upper end portions neither cross nor diverge apart from each other but are held in parallel, coplanar relationship to each other. The slide fastener of FIG. 1 can therefore be easily stitched onto a desired article.

With reference again to FIG. 2 in particular, a pair of lugs 32 at the lower end of the web 24 and another lug 33 at its upper end are intended to be engaged by a feed mechanism (not shown) in automatically feeding the bridge top stop 23 to an attachment machine (not shown) during its attachment process. The web 24 is further shown to have a pair of recesses 34 on both sides of its mid-portion, in order to economize the material from which the top stop is made.

Although the bridge top stop in accordance with this invention has been shown and described in terms of its specific adaptation, it is understood that the invention itself is not to be restricted by the exact details of the disclosure herein. Other adaptations and numerous modifications of the invention will readily occur to those skilled in the art without departing from the spirit or scope of the following claims.

What is claimed is:

1. A slide fastener comprising a pair of stringer tapes having beaded inner edges, rows of interlocking fastener elements attached to the beaded inner edges of the stringer tapes, a slider movable along the rows of fastener elements for engaging and disengaging same, and a bridge top stop attached to the upper ends of the stringer tapes for limiting the upward movement of the slider, the bridge top stop including a web having a lower end wider than its upper end, the web being formed integral with a pair of first legs disposed on both sides respectively of its lower end and engaging the respective beaded inner edges of the stringer tapes to maintain same in spaced parallelism, the web being further formed integral with a pair of second legs disposed on both sides respectively of its upper end and engaging the respective beaded inner edges of the stringer tapes to maintain same in close juxtaposition, said second legs being disposed around and over said beaded inner edges and having their end portions extending parallel to and contacting each other.

2. A slide fastener comprising a pair of stringer tapes having beaded inner edges, rows of interlocking fastener elements attached to the beaded inner edges of the stringer tapes, a slider movable along the rows of fastener elements for engaging and disengaging same, and a bridge top stop attached to the upper ends of the stringer tapes for limiting the upward movement of the slider, said bridge top stop including a web having a lower end wider than its upper end, the web being formed integral with a pair of first legs and each first leg being disposed on a respective side of the lower end of the web and piercing a respective stringer tape so as to maintain said beaded inner edges in spaced parallel and coplanar relationship to each other, adjacent the lower end of the web, the web further being formed integral with a pair of second legs and each second leg being disposed on a respective side of the upper end of the web and spaced from the other second leg a distance approximately equal to the total width of the two inner beaded edges, the second legs piercing respective stringer tapes so as to maintain said beaded inner edges in parallel and close contact to each other adjacent the upper end of the web.

3. A slide fastener as claimed in claim 2, wherein said first legs are clinched inwardly so as to encircle said beaded inner edges and said first legs have their ends abutting against a under surface of said web.

4. A slide fastener as claimed in claim 2, wherein the two pairs of legs have bias-cut ends to accommodate piercing of the stringer tapes.

* * * * *